US011066916B2

(12) United States Patent
Min et al.

(10) Patent No.: US 11,066,916 B2
(45) Date of Patent: Jul. 20, 2021

(54) NOZZLE AND INJECTION DEVICE FOR USE IN UNDERGROUND COAL GASIFICATION PROCESS AND METHOD FOR OPERATING INJECTION DEVICE

(71) Applicant: ZHONGWEI (SHANGHAI) ENERGY TECHNOLOGY CO. LTD, Shanghai (CN)

(72) Inventors: Zhenhua Min, Shanghai (CN); Yuanli Wang, Shanghai (CN); Casper Jan Hendrik Burger, Shanghai (CN)

(73) Assignee: ZHONGWEI (SHANGHAI) ENERGY TECHNOLOGY CO. LTD, Shanghai (CN)

( * ) Notice: Subject to any disclaimer, the term of this patent is extended or adjusted under 35 U.S.C. 154(b) by 167 days.

(21) Appl. No.: 16/477,744

(22) PCT Filed: Mar. 6, 2017

(86) PCT No.: PCT/CN2017/075718
§ 371 (c)(1),
(2) Date: Jul. 12, 2019

(87) PCT Pub. No.: WO2018/129796
PCT Pub. Date: Jul. 19, 2018

(65) Prior Publication Data

US 2019/0360318 A1 Nov. 28, 2019

(30) Foreign Application Priority Data

Jan. 12, 2017 (CN) ..... 201710022286.7

(51) Int. Cl.
*E21B 43/295* (2006.01)
*E21B 43/243* (2006.01)
(Continued)

(52) U.S. Cl.
CPC ..... *E21B 43/295* (2013.01); *E21B 10/61* (2013.01); *E21B 41/0078* (2013.01);
(Continued)

(58) Field of Classification Search
CPC ... B05B 1/005; B05B 15/14; E21B 2010/607; E21B 10/61; E21B 41/0078;
(Continued)

(56) References Cited

U.S. PATENT DOCUMENTS 4,479,540 A * 10/1984 Grenier ..... E21B 36/02 166/260
5,055,030 A * 10/1991 Schirmer ..... E21B 43/24 431/10

(Continued)

FOREIGN PATENT DOCUMENTS

CN 103541714 A 1/2014
CN 103742121 A 4/2014

(Continued)

OTHER PUBLICATIONS

International Search Report; PCT/CN2017/075718; dated Sep. 27, 2017.

*Primary Examiner* — Janine M Kreck
*Assistant Examiner* — Michael A Goodwin
(74) *Attorney, Agent, or Firm* — Dunlap Bennett & Ludwig, PLLC; Brendan E. Squire

(57) ABSTRACT

An injection device, which comprises a nozzle and which is used for an underground coal gasification process; the nozzle and the injection device are used for continuously injecting a high-concentration oxidant into an underground coal layer during the underground coal gasification process, in which case the high-concentration oxidant may be used safely and steadily to obtain a high-quality and stable product gas, while a retraction cycle and/or a retraction
(Continued)

distance of a retraction method in the existing technology may be greatly shortened, thus achieving the continuous and steady operation of the underground coal gasification process. Also disclosed is a method for operating the injection device.

20 Claims, 6 Drawing Sheets

(51) Int. Cl.

| | |
|---|---|
| ***E21B 10/61*** | (2006.01) |
| ***E21B 41/00*** | (2006.01) |
| *B05B 15/14* | (2018.01) |
| *B05B 1/00* | (2006.01) |
| *E21B 29/00* | (2006.01) |
| *E21B 34/06* | (2006.01) |
| *E21B 47/06* | (2012.01) |
| *E21B 47/07* | (2012.01) |

(52) U.S. Cl.
CPC ..... *E21B 43/243* (2013.01); *B05B 1/005* (2013.01); *B05B 15/14* (2018.02); *E21B 29/00* (2013.01); *E21B 34/06* (2013.01); *E21B 47/06* (2013.01); *E21B 47/07* (2020.05)

(58) Field of Classification Search
CPC .... E21B 43/243; E21B 43/247; E21B 43/248; E21B 43/29; E21B 43/295; E21B 29/00; E21B 34/06; E21B 47/06
See application file for complete search history.

(56) References Cited

U.S. PATENT DOCUMENTS

| | | | | |
|---|---|---|---|---|
| 2003/0136585 | A1 | 7/2003 | Matsuo et al. | |
| 2013/0312950 | A1* | 11/2013 | Shaikh | E21B 43/243 166/59 |
| 2016/0076344 | A1* | 3/2016 | Lixin | F22B 1/1853 122/31.1 |

FOREIGN PATENT DOCUMENTS

| | | | | |
|---|---|---|---|---|
| CN | 204082121 | U | | 1/2015 |
| CN | 104533377 | A | | 4/2015 |
| CN | 104564008 | A | | 4/2015 |
| CN | 104612652 | A | | 5/2015 |
| CN | 104632182 | A | * | 5/2015 |
| CN | 204455019 | U | | 7/2015 |
| CN | 205243495 | U | | 5/2016 |
| WO | 2014/043747 | A1 | | 3/2014 |
| WO | 2014/186823 | A1 | | 11/2014 |

* cited by examiner

B–B

A–A

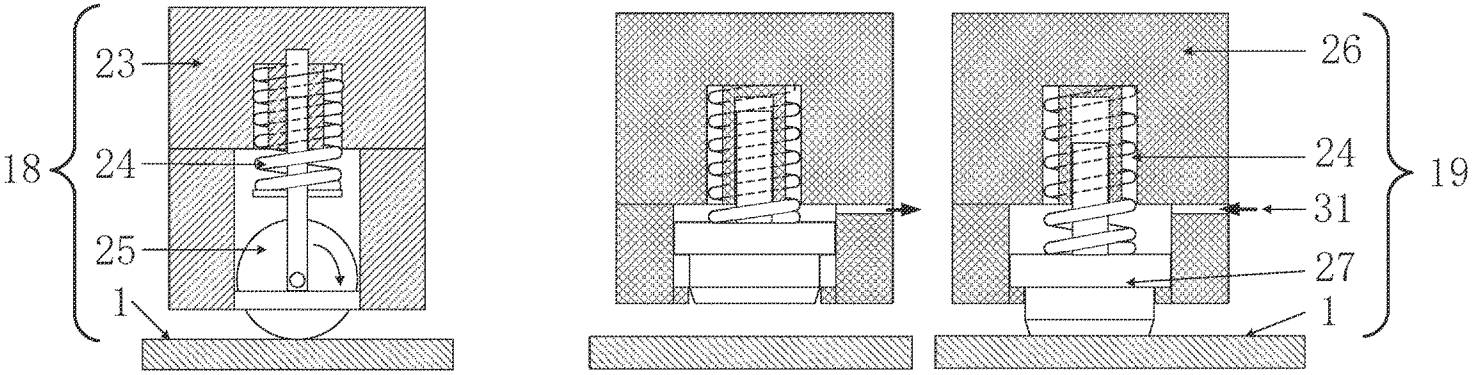
Figure 3(a)
Figure 3(b)
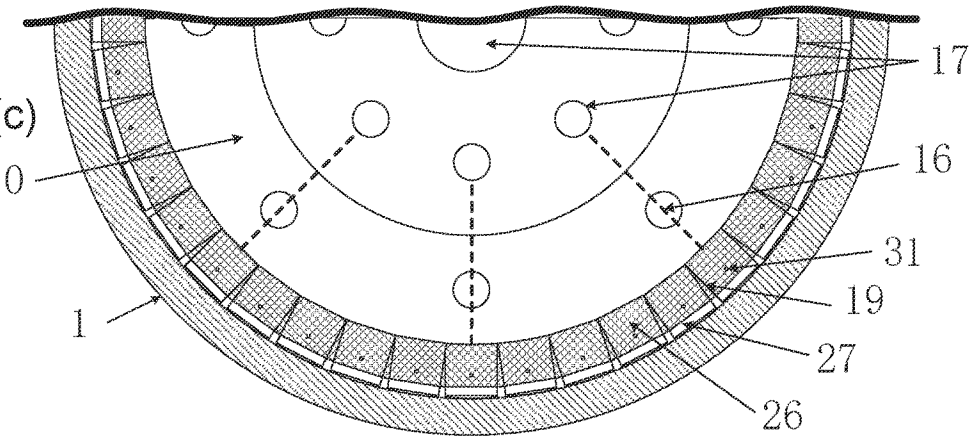
Figure 3(c)

NOZZLE AND INJECTION DEVICE FOR USE IN UNDERGROUND COAL GASIFICATION PROCESS AND METHOD FOR OPERATING INJECTION DEVICE

TECHNICAL FIELD

This invention provides a nozzle, an injection device and operating method for the injection device for the underground coal gasification process. In particular, according to this invention, the nozzle and the injection device can be used to continuously inject high concentration of oxidant into an underground coal seam during the underground coal gasification process.

BACKGROUND ART

Underground coal gasification (UCG or ISC) is a process by which a coal seam is converted into a product gas, by controlled combustion (incomplete combustion) and gasification reaction of the underground coal seam. The product gas is typically referred to as syngas and can be used in processes such as fuels production, chemical production and power generation. The underground coal gasification process integrates well construction and completion, underground coal mining and coal gasification technology and has the advantages of good safety, low investment, high profit and less pollution.

During the UCG process, the corresponding well completion system is generally constructed in the underground coal seam. The well completion system includes an injection well for injecting a variety of reagents such as oxidant, gasification reagent and coolant; a production well for extracting product gas; and other auxiliary support wells, wherein the injection well, production well and support wells are usually fitted with a casing and/or well liner and are connected as required, wherein the support wells generally include an ignition well, coolant delivery well, monitoring well and a guard well. The injection well is usually a horizontal directional well. The production well and support wells are usually horizontal directional wells or vertical wells.

During the UCG process, the most basic well completion system consists of an injection well, a production well and a substantial horizontal wellbore linking each other and to be completed with casing and/or well liner, which is typically referred to as an underground coal gasification unit or a well pair. The underground coal gasification unit or well pair usually comprises of a combustion zone, a gasification zone and a pyrolysis zone, wherein: the gasification zone is mainly where the coal gasification process and partial oxidation produces product. With the gradual advancement of the underground coal gasification process, the burned area formed within the coal seam gradually grows in size. Finally, the sub-surface coal reserve is completely consumed, leaving only coal ash.

During the UCG process, the produced product gas usually includes CO, $CO_2$, $H_2$, $CH_4$ and solid particles, water, coal tar and hydrocarbon, and small amount of $H_2S$, $NH_4$ and COS etc. The specific composition of the above-mentioned product gas is dependent on multiple factors, including the oxidant used (e.g. air, oxygen-enriched air or pure oxygen), the presence of water (coal inherent moisture or ingress water from surrounding strata), the coal quality, and the process parameters used (temperature, pressure, etc.).

During the UCG process, it is usually preferred to use an oxidant with a higher oxygen concentration, because the higher the oxygen concentration, the higher the product gas quality such as the calorific value. When the oxygen concentration is too high, such as greater than 35 vol %, cooling reagents must be used at the same time to prevent too high temperatures of the combustion zone and excessively high back-burns rates, which is where devices in prior art are still having some difficulties when applying high concentration oxidant.

CN103541714A discloses a nozzle and an underground coal gasification method. The injection device comprises of a cylindrical casing, the casing comprises of two parts which are hydraulically connected through at the front hole, and the second part of the casing is provided with a side hole on the side wall. The nozzle further comprises a sealed component and a spring inside which can slide open or close the front hole and the side hole, wherein the opening and closing of the front hole and side hole are controlled by adjusting the injection flow rate of the gasification reagent, the injection pressure, and the pressure of the outlet pathway port. However, the internal structure of the nozzle (e.g. in the oxidant pathway) is obviously complicated and mostly metal components, so that at a higher oxygen concentration, the metal particles generated by the friction between the metal components may result in particle impingement ignition spontaneous combustion, therefore burning the equipment. Moreover, when the side hole actuation is controlled by the injection pressure, the pressure fluctuation tends to cause the high-temperature syngas to flow backward into the nozzle and directly make contact with the oxidant, which may cause combustion or explosion inside the nozzle, and resulting in challenges for safe use.

CN104533377A discloses a nozzle and a gasification method, the nozzle being a sleeve structure comprising a centre tube and an outer ring sleeve. The tapered structure at the end of the centre tube and the outer ring sleeve forms a nozzle top cap, and the nozzle top cap is provided with a gas injection port which is hydraulically connected with the centre tube, and a plurality of water spray holes are arranged on the outer ring sleeve. Oxygen containing gasification reagent is injected through the centre tube, and water or aqueous solution are injected into the gasifier through the side wall and the water spray holes of the top cap. In this invention, a separately designed nozzle top cap is applied and the connection and separation of the centre tube and the outer ring sleeve are mainly achieved by the connection sleeve.

CN104564008A discloses an underground coal gasification device and a gasification method, which comprises a gas injection pipe and a water inlet pipe located in the gas injection pipe and a nozzle fixed on the gas injection pipe, wherein the nozzle jacket is provided with a water jacket connected with the water inlet pipe. Water spray holes are provided on the shaft wall of the water jacket, and a water injection control sleeve for controlling the water outlet is equipped on the water jacket, and the water injection control sleeve is connected to the pull rod of the outer casing spring. One end of the spring is fixed on the gas injection pipe and the other end is offset against the water injection control sleeve. Obviously, such a gasification device also has a relatively complicated structure, and wherein the oxidant delivery pathway is an annular space, which causes the oxidant to be directly exposed to a possible high temperature environment, resulting is challenges for safe use.

CN205243495U discloses a nozzle and a gasification reagent delivery system using the nozzle, wherein the nozzle comprises of a ceramic body and a metal protective sleeve, and the protective sleeve is wrapped around the nozzle body, but wherein the protective sleeve is only used to protect the nozzle and does not have any active cooling mechanisms, and furthermore, there is no reverse flow protection mechanism at all. Therefore, such nozzles cannot be safely or efficiently used in the UCG for high concentrations of oxidant such as pure oxygen.

CN204455019U discloses a process burner assembly comprising a burner body (including concentrically disposed burner tubes and a water conduit and a cooling tube) and a gas sampling component (including a centre tube in communication with the water conduit and a cooling tube). This burner considers the cooling mechanism more comprehensively, but the cooling coil wrapped around the outer surface of the component results in high torque and drag forces when the equipment enters and exits the well, and the heat dissipation requirement limits the wall thickness of the cooling coil, so that the cooling coil can be easily damaged in the underground environment. In addition, there is no reverse flow protection mechanism for the entire burner and conveying system, and resulting in problems for safe use.

WO2014/043747A1 discloses a device and method for carrying out an oxygen-enriched underground coal gasification process, in particular, an oxygen injection device and method, in which a specially designed oxygen lance is used to inject oxidant into an underground coal seam, wherein the lance comprises: a pipe body with an internal pathway, having a check valve inserted therein; a coiled tubing adapter at the tail end of the pipe body, the adapter having a hole for a thermocouple; at least one spacer tube connected to the front end of the pipe body; an injection nozzle at the front end of the tube; and a thermocouple that monitors the temperature of the injection nozzle. Although the patent mentions oxygen-enriched underground coal gasification, the oxygen injection equipment lacks its own cooling mechanism and is not suitable for underground coal gasification with high concentration of oxidant.

WO2014/186823A1 discloses a device and method for supplying oxidant and water to a coal seam during underground coal gasification, wherein the device comprises an oxidant pathway and a casing seal, the oxidant pathway comprising at least one downhole end opening and at least one opening at the upper end of the well. The downhole end opening is used for injecting oxidant into the underground coal gasification zone, and the upper end opening of the well is used for fluid connection with the coiled tubing. The casing seal is used for sealing the annular pathway between the oxidant pathway and the wellbore casing. The casing seal has one or more pathways for injecting water into the underground coal gasification zone. However, the casing seal in this patent makes it extremely difficult for the equipment to enter and exit the wellhead and pass through the directional well curvature area, and although the oxidant in this patent can be substantially pure oxygen, the pressure of the water column itself in the water injection pathway makes the controlled retraction process very complex and difficult to implement.

Therefore, the nozzles and relevant devices used in the underground coal gasification process in the prior art still have some shortcomings or challenges in structural design and safe use, and further improvement is needed.

SUMMARY OF INVENTION

This invention aims to overcome the shortcomings of the prior art and solve related challenges, thereby providing a nozzle and an injection device that can continuously inject high concentration oxidant in an underground coal gasification process.

This invention provides a nozzle, injection equipment and operating method of the injection device for the underground coal gasification (UCG) process. In particular, according to this invention, the nozzle and the injection equipment can be used to continuously inject high concentration oxidant into the sub-surface coal seam during the UCG process.

This invention provides a nozzle for the UCG process, the nozzle comprising a centre tube and a casing. The centre tube and the casing extend from the connection end to the injection nozzle end, the two being concentric with an annular space between them. The outer casing extends from the connection end to form an annular end face and the encapsulating jet end forms an injection nozzle end face, wherein the centre tube and the casing are connected by a non-sealed spiral and thereby form a spiral flow pathway in the nozzle annulus, wherein a plurality of pairs of coolant inlets and coolant outlets corresponding to each other and connected and matched with the spiral flow pathway on the annular end face of the connection end and the injection nozzle end face, and wherein the injection nozzle end face is further provided with oxidant injection holes.

This invention also provides injection equipment for the UCG process, which is based on an injection well liner as the equipment conveying channel. The injection equipment for this invention comprises coiled tubing, a mechanical shearing device and a nozzle which have a gas tight connection and are connected in series with each other, wherein: the coiled tubing is used to move the injection device through a well liner to a pre-determined location within the underground coal seam to be gasified, and, if necessary, retract all or part of the injection device to the surface; A mechanical shearing device is used to disconnect the nozzle when necessary, to retract the remainder of the injection device; and the nozzle is used to inject coolant and oxidant into the coal seam for gasification.

This invention further provides an operation method of applying the injection device of this invention in the UCG process, wherein a well completion system for UCG is provided in the underground coal seam, wherein the nozzle centre tube of the injection device and the internal pathways of the other components together form an oxidant pathway, and the spiral flow pathways in the nozzle annulus of the injection device together with the annulus between the other components and the inner wall of the injection well liner constitute a coolant pathway. The method of operation comprises the following stages:

Preparation stage, including:

The injection equipment is connected to the underground ignition device by means of a quick connector to the injection nozzle end of the injection device;

Using the wellhead control device of the injection well, deliver the entire injection device and the underground ignition device to a pre-determined ignition location within the underground coal seam by using the coiled tubing of the injection equipment;

Ignition phase, wherein the underground coal seam ignition is performed in a delayed manner, including:

Injecting an oxidant flow through the oxidant pathway or applying pressure to activate and subsequently disconnect the underground ignition device, wherein a low flow rate of air is used as an ignition oxidant and injected into the underground coal seam through the coolant pathway;

Gasification phase, wherein the underground coal gasification process is carried out according to the retraction method, including:

Injecting a coolant through the coolant pathway and adjusting the injection pressure and/or flow rate of the coolant to seal the annular space between the inner wall of the injection well liner and the nozzle;

Continuously injecting oxidant into the underground coal seam through the oxidant flow path to carry out underground coal seam gasification;

The injection device is retracted a certain distance according to a certain time interval to continue the gasification process until all the coal in the direction of the injection well liner is consumed, wherein the injection pressure and/or flow rate of the coolant are adjusted during the retraction process to unseal the annular space between the inner wall of the injection well liner and the nozzle to facilitate the retraction operation.

According to the present invention, the nozzle adopts a structure in which a centre tube is combined with an outer casing, wherein the centre tube is an oxidant pathway, and the annular space between the centre tube and the outer casing is a coolant pathway. The centre tube is connected to the outer casing by a non-sealed spiral connection, and while the non-sealed spiral is used for connection, it also forms a spiral flow pathway for the coolant to pass through, thereby forming a flowing annular cooling jacket on the nozzle, which can effectively cool down the nozzle while the nozzle is in operation, thereby preventing the nozzle from being burnt and having structural deformation in the UCG process, thereby improving the safety of the nozzle.

Furthermore, according to this invention, the injection equipment is formed by further combining a coiled tubing and a mechanical shearing device behind the nozzle, wherein the coiled tubing, as a conveying device, accurately transports and positions the nozzle, and the mechanical shearing device is able to disconnect the nozzle when necessary to retract the injection device components including the coiled tubing to at least a safe position for subsequent use, and the nozzle is used for injecting reagents such as coolant and oxidant into the underground coal seam. By applying the injection equipment with this configuration, high concentration oxidant can be continuously injected into the underground coal seam, to safely produce stable and high quality of product gas from the underground coal seam.

In addition, according to this invention, a method of operating the injection device is also provided, wherein the UCG process can be continuously performed using a high concentration oxidant based on the efficient cooling of the nozzle and the safety of the injection equipment used, the retraction cycle and/or retraction distance in the burn-back method of the UCG in the prior art can be further shortened, thereby realizing a substantially continuous UCG process.

Therefore, the nozzle, the injection equipment and the corresponding injection device operation method of this invention can help to perform the UCG process more safely and efficiently, which brings an advancement to the prior art.

BRIEF DESCRIPTION OF DRAWINGS

This invention is further described below with reference to the accompanying drawings, wherein:

FIG. 1(*b*) is a longitudinal sectional view of the injection device with a bayonet/positioning bolt connector.

FIG. 1(*c*) is a longitudinal sectional view of the injection device with a flange and bolt connector.

FIG. 2(*b*) is a cross-sectional view along the B-B line of FIG. 1;

FIG. 3(*a*) is a cross-sectional view of the main check valve support of this invention;

FIG. 3(*b*) is a cross-sectional view of the nozzle support ring of this invention;

FIG. 3(*c*) Is a front view of the tool, combining the detail from FIG. 2(*b*) with the detail from FIG. 3(*b*) to show the implementation of the seal ring.

In the respective drawings, the same reference numerals are used to refer to the same parts. In particular, the meanings of the referenced numerals involved in the respective drawings are as following:

Figure 1A:
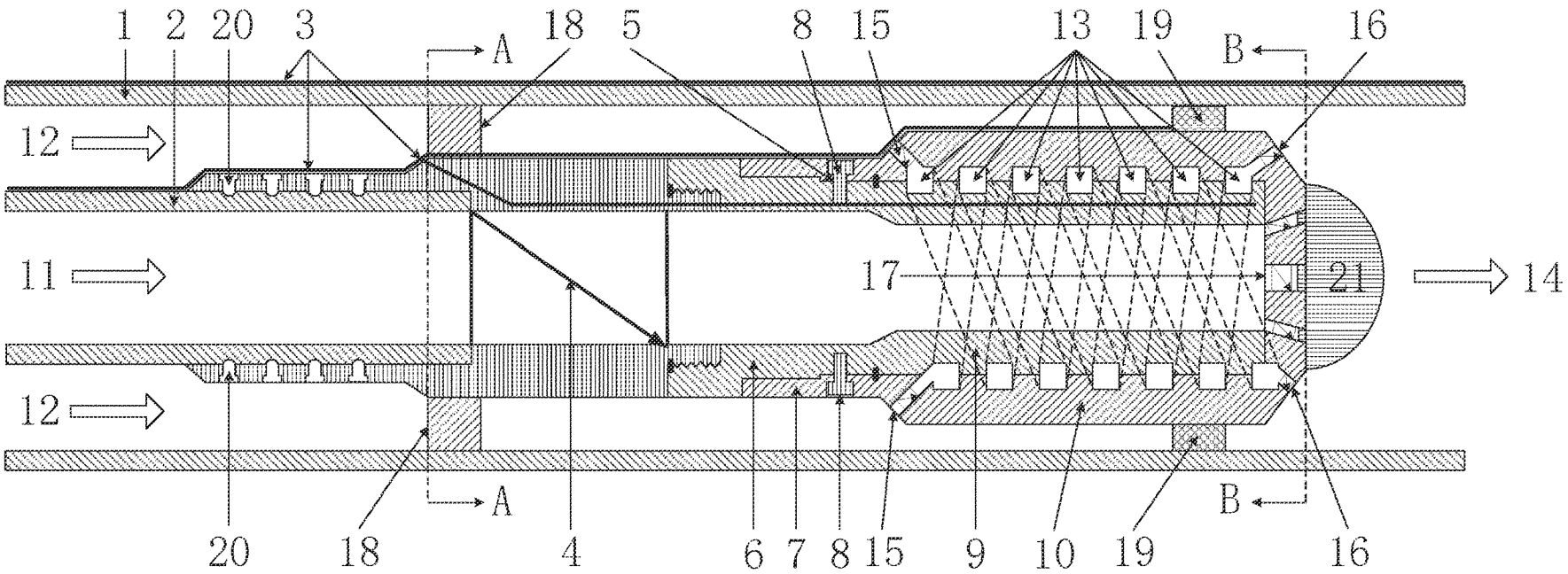
FIG. 1(*a*) is a longitudinal sectional view of the injection device with an external grapple connector.

1. Injection well liner; 2. Coiled tubing; 3. Distributed temperature, pressure and acoustic wave sensors (fixed on the outside of the injection well liner, outer wall of the coiled tubing and the inside of the nozzle center (centre) tube); 4. Main check valve (located between the coiled tubing and mechanical shearing device); 5. Mechanical shearing device; 6. Main body of the shearing device; 7. Outer casing of the shearing device; 8. Shear pins; 9. Nozzle center (centre) tube; 10. Nozzle casing; 11. Oxidant pathway; 12. Coolant pathway; 13. Spiral flow channel (formed by a non-sealed spiral inside the nozzle annulus); 14. Combustion zone and gasification zone; 15. Coolant inlet; 16. Coolant outlet; 17. Oxidant injection hole; 18. Main check valve support component; 19. Nozzle support ring; 20. External grapple connector; 21. Nozzle pneumatic protection plug; 22. Micro venturi drainage patterns; 23. U-shaped support legs; 24. Spring; 25. Wheel; 26. U-shaped support ring; 27. Seal ring; 28. Oxidant and coolant mixture; 29. Coal seam; 30. Cavity; 31. U-shaped support ring cavity and nozzle ring annular communication channel, a bayonet 32/positioning bolt 33, and a flange 34 and bolt 35 connector.

DESCRIPTION OF EMBODIMENTS

This invention will be further described in detail below with reference to the accompanying drawings.

This invention provides a nozzle for an underground coal gasification (UCG) process, the nozzle comprising a centre tube and an outer casing. The centre tube and the casing extend from the connection end to the injection nozzle end, the two being concentric and are spaced by the annular space in-between them. The outer casing extends from the connection end to form an annular end face and the encapsulating jet end forms an injection nozzle end face, wherein the centre tube and the casing are connected by a non-sealed spiral and thereby forming a spiral flow pathway inside the nozzle annulus, wherein a plurality of coolant inlets and coolant outlets pairs, corresponding to each other and communicating and matching with the spiral flow pathways, are provided on the annular end face of the connection end and the injection nozzle end face, and wherein the injection nozzle end face is further provided with oxidant injection holes.

According to this invention, as the equipment are to be used in a high concentration oxidant environment in the UCG process, the manufacturing materials of the nozzles and relevant components must be adapted to the environment of high temperature and high-pressure pure oxygen and high-velocity oxygen flow, and therefore suitable materials shall be selected from the group consisting of brass, Inconel, Monel and so on (e.g. Inconel in Chinese: nickel-based alloy with chromium and iron; Monel in Chinese: Ni—Cu alloy).

According to this invention, the centre tube of the nozzle, which is a high concentration oxidant pathway, must be adequately clean to be suitable for the pure oxygen environment, that is, free of particulate or hydrocarbon contamination. In addition, the inner surface of the nozzle requires special treatment to prevent the risk of auto-ignition resulting from particle impact on the inner surface of the metal under high concentration oxidant environment; Moreover, the outside of the nozzle needs to be smooth, and any dimensional change must be a gradual transition process, to facilitate smooth movement inside the injection well liner while also ensuring a gas-tight seal when passing through the wellhead control device; Further, the outer casing of the nozzle needs to be thick enough, for example 10-20 mm, to withstand thermal radiation, heat convection and heat transfer from the high temperature combustion zone and the gasification zone and corresponding cooling requirements should be adopted to prevent reverse burn during operation and to ensure the integrity and reliability of the nozzle equipment.

According to this invention, the connection end of the nozzle is to connect with other components during use, and the injection nozzle end is used for injecting reagents such as oxidant and coolant into the underground coal seam during use, wherein the centre tube and the outer casing both extend from the connection end to the injection nozzle end, the two being concentric and are spaced by the annular space in-between them, wherein the outer casing extends from the connection end to form an annular end face and the encapsulating jet end forms an injection nozzle end face, such that both the annular end face of the connection end and the injection jet end face are both part of the nozzle casing.

According to this invention, the centre tube of the nozzle is connected to the outer casing by a non-sealed spiral, the non-sealed spiral forms a spiral flow pathway inside the nozzle annulus, and the depth and width of the non-sealed spiral thread spacing are independently 2-10 mm, and preferably 4-8 mm, such that the spiral flow pathway meets the coolant flow requirements as well as the heat dissipation requirements and cooling efficiency of the nozzle.

According to this invention, the spiral flow pathway formed by the non-sealed spiral inside the nozzle annulus, is the main coolant pathway, wherein the coolant flows through the nozzle annulus to perform jacketed dynamic cooling, and, due to the threaded connection, it is convenient to replace and maintain the nozzle casing according to the actual operation conditions and operation requirements of the coal seam. For example, when replaced after damage, adjust the number of coolant inlets and coolant outlets, adjust the number of oxidant injection holes, and adjust the thickness of the nozzle casing.

According to this invention, in addition to the non-sealed spiral connection, the centre tube and the outer casing are further connected and fixed at the connection end by a non-welded connection which can be selected from an external grapple connector, bayonet/positioning bolt or flange bolt, in order to prevent difficulties when the threaded connection between the centre tube and the outer casing loosens during the underground transfer process.

According to this invention, the nozzle is provided with a plurality of pairs of coolant inlets and coolant outlets (for example, 4-12 pairs), corresponding to each other and communicating and matching with the spiral flow pathways on the end faces of the connection end and the injection nozzle end. These coolant inlets and coolant outlets are evenly distributed along the circumference.

According to this invention, the nozzle is further provided with one or more oxidant injection holes on the end face of the injection nozzle end, the total open area may be determined based on the maximum required injection velocity of the oxidant, and when a plurality of oxidant injection holes are provided, these holes may be distributed along the centreline and the periphery, and the outer holes may be parallel to the centre hole or may be diverged outward at an angle of 5-35°, preferably 8-20°, to the centre hole, to optimize the injection distance and spray dispersion range of the oxidant in the combustion zone and the gasification zone.

According to this invention, the nozzle may be provided with an auxiliary check valve at each of the coolant inlets and each of the coolant outlets and each of the oxidant injection holes to prevent reverse flow of flammable and explosive gases from entering into the coolant pathway, during the retraction process of the injection device, causing contamination and damage. Here, the support check valve is a check valve commonly used in the prior art, but may be relatively smaller in size to accommodate the size of the coolant inlet and outlet holes and the oxidant injection hole.

According to this invention, the nozzle may be provided with a plurality of micro-drainage lines on the end face of the injection nozzle end from the coolant outlet to the oxidant injection hole, for example, a micro venturi drainage pattern, which may have a depth of 2-3 mm, for guiding the coolant to reach the oxidant injection holes to perform the required cooling protection.

According to this invention, a support ring may be provided on the nozzle casing near the injection nozzle end (e.g. 3-30 mm from the end face of the injection nozzle end), and the design clearance between the support ring and the inner wall of the injection well liner is generally not more than 10 mm (e.g. 5-10 mm) and includes a U-shaped support ring, a spring and a seal ring, wherein the spring and the seal ring are contained in a U-shaped support ring inner cavity, the inner cavity being in communication with the spiral flow pathway in the nozzle annulus, thereby, the seal ring is ejected by a spring when the coolant is injected to block the design clearance.

According to the above design, the thickness of the seal ring is generally required to be larger than the design clearance, and the extension and retraction of the seal ring are mainly controlled by the injection pressure and/or flow rate of the coolant, so that the annular space between the injection well liner and the nozzle can be sealed when coolant is injected during normal operation, thereby ensuring that all the coolant pass through the spiral flow pathway in the nozzle annulus into the combustion zone and the gasification zone during the gasification process, thereby completely covering and cooling the nozzle device.

According to this invention, the nozzle support ring is generally selected from high-temperature and corrosion-resistant special duplex steels, for example, Inconel, Monel, and tungsten alloy, etc., which can be mounted and connected on the nozzle outer casing through welding, fixing bolts or integrated molding.

This invention also provides an injection device for an underground coal gasification process, which is based on an injection well liner as a conveying channel. The injection device comprises of a coiled tubing, a mechanical shearing device and the nozzle of this invention which have gas tight connections and are connected in series with each other, wherein: the coiled tubing is used to move the injection device through a well liner to a pre-determined location in the underground coal seam for gasification, and, if necessary, retract all or part of the injection device to the surface; A mechanical shearing device is used to cut off the nozzle when necessary to retract the remainder of the injection device; and the nozzle is used to inject coolant and oxidant into the coal seam for gasification.

According to this invention, in the injection device, a main check valve is provided between the coiled tubing and the mechanical shearing device to prevent reverse gas flow into the coiled tubing, and the main check valve is further provided with a support component for positioning and sealing of the injection device, wherein the support component comprises 3 or 4 sets of circumferentially evenly distributed U-shaped support legs, springs and rollers. The design clearance between the U-shaped support legs and the inner wall of the injection well liner shall be no more than 10 mm (e.g. 5-10 mm), the springs and the rollers are included in the cavity of the U-shaped support legs, directly contacting the roller and the inner wall of the injection well liner.

According to this invention, the main check valve support acts as a positioning and sealing function for the injection device, and the support component can generally be made of 316L stainless steel or higher material grade, wherein 3 or 4 sets of circumferentially evenly distributed U-shaped support legs, springs and rollers are used, because coolant flow may be restricted when using more sets of these components.

According to this invention, the main check valve supports adopts 3 or 4 sets of circumferentially evenly distributed U-shaped support legs, springs and rollers to facilitate the free movement of the injection device in the injection well liner, for example, in those cases when passing through the curved part of the injection well liner, when there are obstacles such as solid particles or coal condensate sticking on the inner wall of the injection well liner, or when there is deformation issues with the injection well liner itself, etc., the spring in the support component is able to adjust the extension height of the roller to achieve smooth movement of the entire injection device.

According to this invention, the main check valve is also used to prevent flammable and explosive gases from entering the coiled tubing which can cause contamination and equipment damage, similar to the auxiliary check valves for the coolant inlet, coolant outlet and oxidant injection hole. The main check valve is also a check valve commonly used in the prior art, except that the size is selected based on the inner diameter of the coiled tubing. In addition, both the primary check valve and the auxiliary check valve may be selected by those skilled in the art, to be suitable for use in high concentration oxidant environments such as pure oxygen environment. Examples of the check valves can be a spring flapper check valve or a ball and spring type check valve.

According to this invention, the mechanical shearing device is used to disconnect the nozzle when necessary to retract the remainder of the injection device. For example, when the injection well liner is mechanically damaged due to melting or deformation, disconnecting the nozzle allows prompt retraction of other upstream equipment for maintenance and replacement, thereby reducing equipment loss in the underground coal gasification process to some extent.

According to this invention, the mechanical shearing device utilizes a shear-off (self-cutting/breaking) mechanism and it comprises of the main body of the shearing device, an outer casing of the shearing device and a shear pin, wherein the shear pin is able to cut off the main body and outer casing to achieve disconnection of the nozzle.

According to this invention, the nozzle is located downstream of the mechanical shearing device for injecting highly concentrated oxidant such as pure oxygen and coolant such as water, steam or carbon dioxide into the combustion zone and the gasification zone of the underground coal seam, at which point the coolant forms a moving cooling barrier in the spiral flow channel in the nozzle annulus, thus protecting the entire nozzle device.

According to this invention, a pneumatic protection plug can also be provided at the injection nozzle end for protecting the nozzle device when the injection device enters the downhole well (for example, avoiding mechanical wear and contamination (such as grease drilling mud and coal particle)), and it will be blown off by the high pressure reagent flow after initiating the reagent injection flow, that is, it does not obstruct the injection of the reagent; or a quick connector can be installed at the injection nozzle end for connecting, conveying and disconnecting underground ignition devices during the ignition phase. Therefore, the injection device of this invention can be used in the ignition phase and the normal gasification stage of an underground coal gasification process.

According to this invention, the components of the injection device can be connected to each other and provide a gas tight seal by means of a non-welded connection which could be selected from an external grapple connector, quick connector, bayonet/positioning bolt, and a flange bolt. These non-welded connections are highly advantageous for quick connection and subsequent disassembly and maintenance between the various components.

This invention further provides an operating method of applying the injection device of this invention in an underground coal gasification process, wherein a well completion system for underground coal gasification is provided in the underground coal seam, wherein the centre tube of the nozzle of the injection device and internal pathways of other components together form an oxidant pathway, and the spiral flow pathways in the nozzle annulus of the injection device together with the annulus between the other components and the inner wall of the injection well liner constitute a coolant pathway. The method of operation comprises the following stages:

Preparation stage, including:

Connecting the injection device to the underground ignition device by means of a quick connector onto the injection nozzle end of the injection device;

Using the wellhead control device of the injection well, the entire injection device and the underground ignition device is delivered to a pre-determined ignition position in the underground coal seam by using coiled tubing for the injection device;

Ignition phase, wherein underground coal seam ignition is performed in a delayed manner, including:

Injecting an oxidant flow through the oxidant pathway or applying pressure to activate and subsequently disconnect the underground ignition device, wherein a low flow rate of air is used as an ignition oxidant and injected into the underground coal seam through the coolant pathway;

Gasification phase, wherein the underground coal gasification process is carried out according to the retraction method, including:

Injecting a coolant through the coolant pathway, and adjusting the injection pressure and/or flow rate of the coolant to seal the annular space between the inner wall of the injection well liner and the nozzle;

Continuously injecting oxidant into the underground coal seam through the oxidant pathway to carry out underground coal seam gasification;

The injection device is retracted a certain distance according to a certain time interval to continue the gasification process until all the coal in the direction of the liner in the injection well is consumed, wherein the injection pressure and/or flow rate of the coolant is adjusted during the retraction process to unseal the annular space between the inner wall of the injection well liner and the nozzle, to facilitate the retraction operation.

According to this invention, in the above-mentioned operation method, wherein a high concentration oxidant is continuously injected into the underground coal seam through the oxidant pathway, during the gasification stage, wherein the high concentration oxidant can be oxygen enriched air with at least 80 vol % oxygen, preferably at least 90 vol % oxygen or pure oxygen, wherein the coolant can be water, steam or carbon dioxide, and the coolant is also used as a gasification agent for the coal gasification process, and the burning rate of the injection well liner in front of the injection device can be accelerated by reducing the flow rate of the coolant injection after retraction, so that fresh coal seam can be exposed to the high temperature combustion zone and the gasification zone.

According to this invention, in the operating method, wherein after successful ignition during the ignition phase, the injection device is generally retracted to a safe position to wait for the subsequent start of the gasification phase, and wherein during the gasification phase, the annular space between the inner wall of the injection well liner and the nozzle can be unsealed by adjusting the injection pressure and/or flow rate of the coolant while retracting the injection device. For example, the seal ring can be opened by adjusting the injection pressure and/or flow rate of the coolant in order to make it convenient for the coiled tubing to retract the injection device, and after the retraction is in place, the coolant injection flow rate can be reduced, for example reducing the coolant injection flow rate by 10-80 vol %, to accelerate the burning rate of the injection well liner in front of the injection device, so that fresh coal seam can be exposed to the high temperature combustion zone and the gasification zone, thereby continuing the underground coal gasification process until all coal deposits in the direction of the injection well liner are consumed.

According to this invention, in operating method, wherein distributed temperature, pressure and acoustic wave sensors are used to monitor and control the process parameters of an underground coal gasification process. The distributed temperature, pressure and acoustic wave sensors are respectively disposed outside the injection well liner, the outer wall of the coiled tubing and inside the nozzle centre tube. They are used to obtain temperature, pressure and acoustic wave signals of the underground coal seam and feedback the information to the wellhead control equipment of the injection well.

According to this invention, in the method of operation, wherein the distributed temperature, pressure and acoustic wave sensors are distributed sensing optical fibres based on Optical Time-Domain Reflectometry (OTDR) technology. The optical fibre extends from near the wellhead or from the starting point of the coiled tubing to a target measuring point, and wherein a bimetallic sheathed K-type dual probe thermocouple is additionally or alternatively used at the oxidant injection nozzle to obtain the temperature at that point and the coolant injection flow rate is controlled based on this temperature.

According to this invention, when utilizing the injection device of this invention in an underground coal gasification process, the retraction process can be carried out by controlling the coolant injection pressure and/or flow without interrupting the injection of the oxidant and the coolant, therefore the operation is relatively more flexible and convenient, and can significantly shorten the retraction period and/or the retraction distance of the retraction methods in the prior art, and realize continuous and stable operation of the underground coal gasification process; moreover, the injection device of this invention allows for safe and stable utilization of high concentration oxidant such as pure oxygen, thereby obtaining high- and stable quality product gas; furthermore, according to this invention, the temperature, pressure and acoustic wave signal acquisition system can be used to achieve good control of the entire underground coal gasification process. Therefore, this invention significantly improves upon the prior art and brings technological advancements.

This invention is further described below with reference to the accompanying drawings.

Figure 1B:
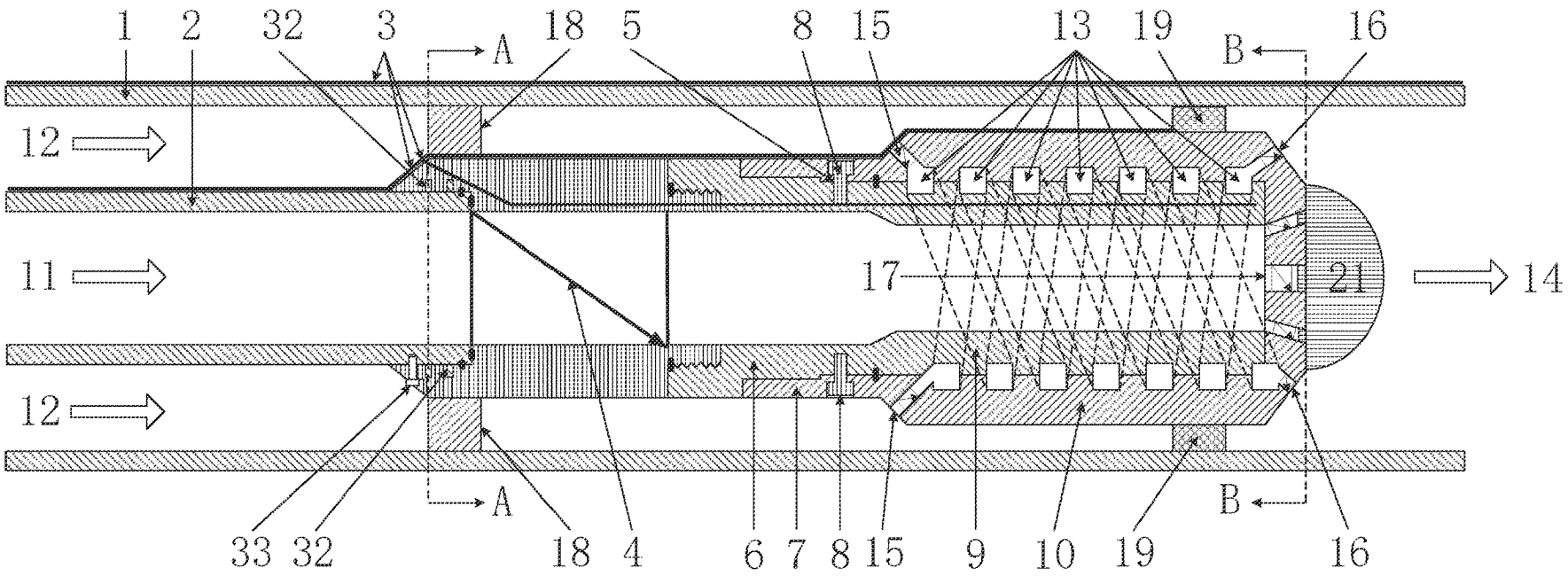
Figure 1C:
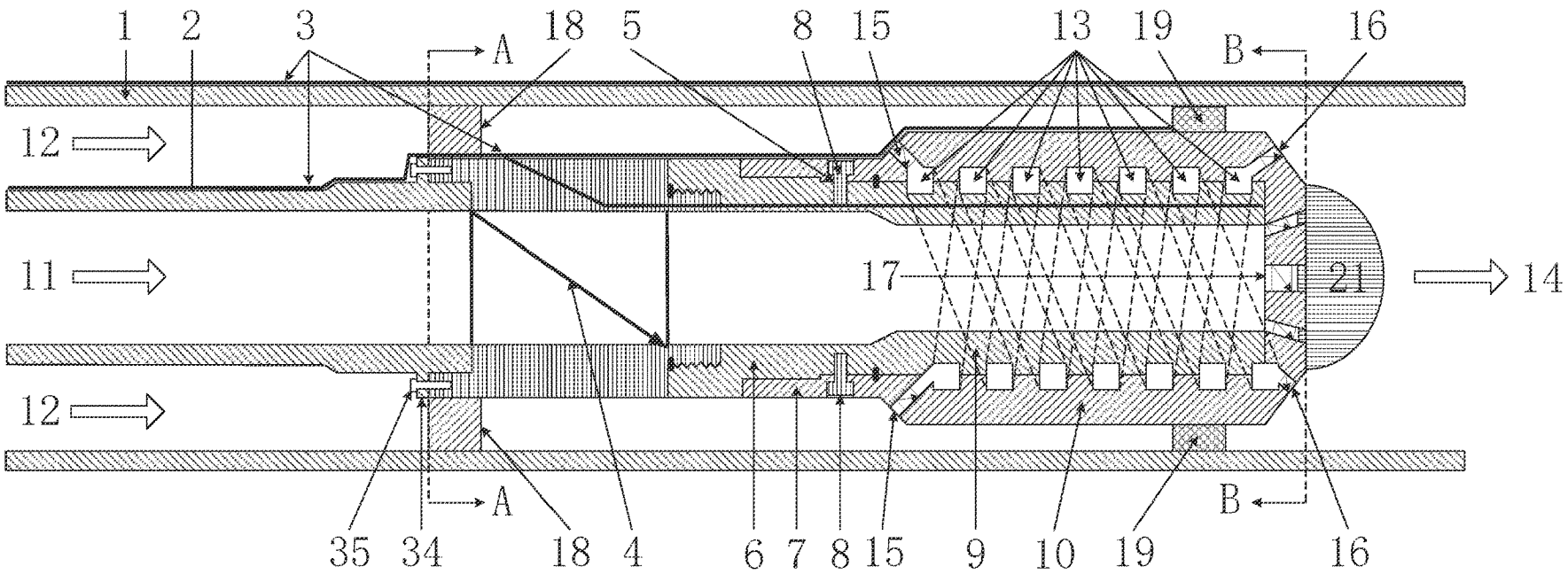
Figure 2B:
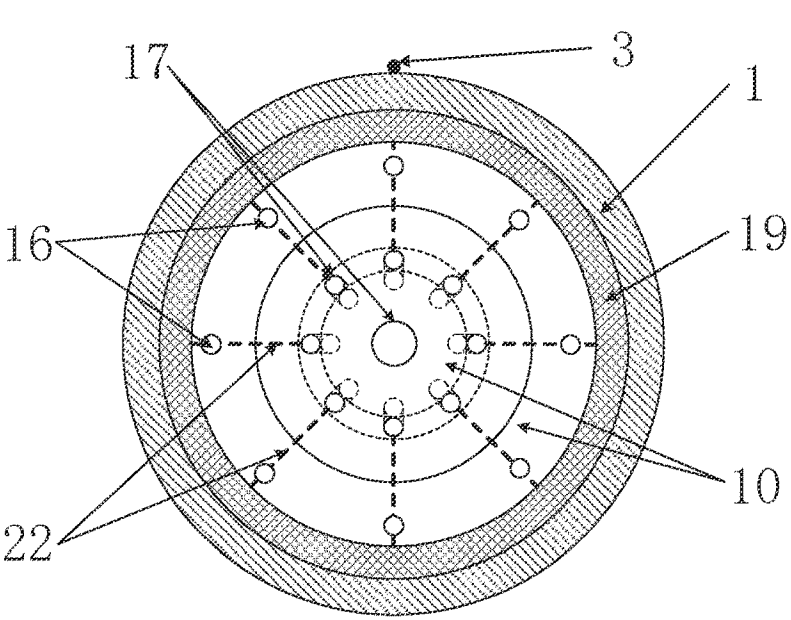
FIG. 2(*a*) is a cross-sectional view along the A-A line of FIG. 1.
Figure 2A:
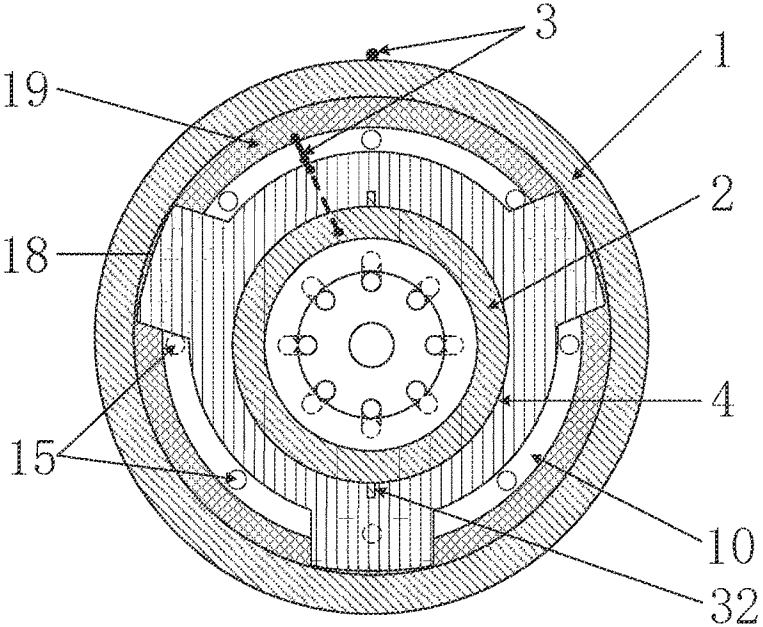

FIGS. 1-3 provides the respective cross-sectional views for the injection device of this invention, a cross-sectional view of the injection device along the A-A cross section, a cross-sectional view along the B-B section, the cross-sectional view of the check valve support component and a cross-sectional view of the nozzle support ring.

As shown in FIG. 1, the coiled tubing 2 is connected to the main check valve 4 via an external grapple connector 20. The main check valve 4 is provided with a support component 18 for positioning and sealing of the entire injection device, and comprising three sets of U-shaped support legs 23, springs 24 and rollers 25 uniformly distributed along the circumference, wherein the springs 24 and rollers 25 are contained inside the cavity of the U-shaped support legs 23, and the roller 25 is in direct contact with the inner wall of the injection well liner (see FIG. 2(*a*) and FIG. 3(*a*)).

The main check valve 4 is connected to a downstream mechanical shearing device 5 which comprises of a main body of the shearing device 6, an outer casing of the shearing device 7 and a shear pin 8 for cutting off the nozzle when necessary to retract the remainder of the injection device such as the coiled tubing 2 or the like.

Downstream of the mechanical shearing device 5 is connected to the connection end of the nozzle. The nozzle comprises a nozzle centre tube 9 and a nozzle casing 10. The nozzle centre tube 9 and the nozzle casing 10 are concentrically disposed and are spaced by the annular space in between them. The nozzle casing extends from the connection end to form an annular end face and the encapsulating jet end forms an injection nozzle end face The nozzle centre tube 9 and the nozzle casing 10 are connected to each other by a non-sealed spiral 13 which forms a spiral flow pathway in the nozzle annulus, which is the main coolant pathway and provides effective circumferential cooling and heat dissipation to the nozzle. 8 pairs of coolant inlets 15 and coolant outlets 16 are uniformly distributed along the circumference are provided on the annular end face of the nozzle and the injection nozzle end face, and each of the coolant inlet and outlet are connected and matched with the internal spiral flow pathway and a support check valve is provided internally (see FIGS. 2(*a*) and 2(*b*)). There are 9 oxidant injection holes 17 provided on the injection nozzle end (see FIG. 2(*b*)) and a quick connector (not shown in the figure) is provided for connecting, conveying and disconnecting underground ignition devices during the ignition phase.

A nozzle support ring 19 is provided on the nozzle casing 10 near the injection nozzle end, and the support ring 19 is used for sealing the annular space between the inner wall of the injection well liner and the nozzle device, to allow the coolant to pass through the spiral flow pathway in the nozzle annulus to sufficiently cool the nozzle, and the support ring 19 includes a U-shaped support ring 26, a spring 24 and a seal ring 27, wherein the spring 24 and the seal ring 27 are contained inside the cavity of the U-shaped support ring 26 and the seal ring 27 is ejected by a spring 24 when coolant is injected to directly contact the inner wall of the injection well liner to achieve a seal (see FIGS. 2(*b*) and 3(*b*)).

When the injection device enters the underground coal seam through the injection well liner, it is necessary to install a pneumatic protection plug 21 at the injection nozzle end to protect the nozzle and prevent contaminants from entering the injection device.

The distributed temperature, pressure and acoustic wave sensors 3 are respectively attached onto the outside of the injection well liner, on the outer wall of the coiled tubing and inside the nozzle centre tube, and are used to obtain relevant temperature, pressure and acoustic wave signals, which is fed back to the wellhead control equipment of the injection well, therefore controlling the underground coal gasification process.

Figure 4:
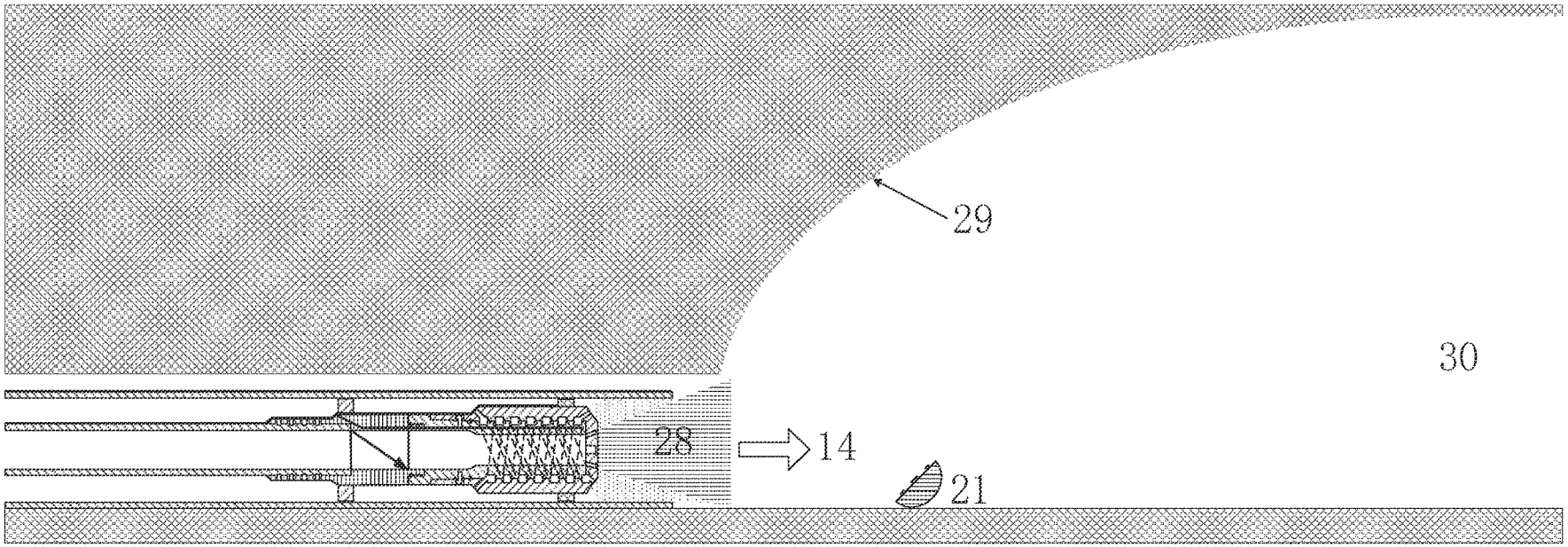
FIG. 4 is a schematic view showing the operation method of the injection device of this invention.

Furthermore, as shown in FIG. 4, wherein a schematic view of the operation method (under normal production process) for the injection device of this invention is provided, in which the coolant is injected through the coolant pathway 12 of the injection device, and the annular space between the inner wall of the injection well liner and the nozzle device can be sealed by increasing the coolant injection pressure (the seal ring 27 is ejected by the spring 24 to directly contact the inner wall of the injection well liner), wherein oxidant is injected through the oxidant pathway 11 of the injection device, and after the pneumatic protection plug 21 is blown off, underground coal gasification is started, wherein oxidant and coolant (also used as a gasification agent) are mixed at the front end of the nozzle to form an oxidant and coolant mixture 28, and then enter the combustion zone and the gasification zone 14 to perform underground coal gasification process.

The description of this application is merely a preferred embodiment of this invention, but this invention is not limited to these preferred embodiments. Other variations and modifications of this invention are possible without departing from the spirit and scope of this invention, and such variations and modifications are within the scope of this invention.

The invention claimed is:

1. A nozzle for an underground coal gasification process, the nozzle comprising:

an outer casing having a connector at a proximal end and an injection nozzle end face defined at a distal end, a center tube extends from the proximal end to the injection nozzle end face, the center tube and the outer casing being concentric and spaced apart by an annular space, a non-sealed spiral flow pathway is defined in the annular space along a length of the center tube a plurality of coolant inlets and coolant outlets corresponding to each other and communicating and matching with the non-sealed spiral flow pathway are provided on an annular end face of the proximal end and the injection nozzle end face respectively, the plurality of coolant inlets disposed about the annular end face in a spaced apart relation and oriented to receive a coolant carried in a coolant flow path defined in an annular space between a well liner and the outer casing, the plurality of coolant outlets radially disposed about the injection nozzle end face and oriented to eject the coolant into a combustion zone and a gasification zone in an underground coal seam;

one or more oxidant injection holes disposed in the injection nozzle end face; the one or more oxidant injection holes configured to inject an oxidant communicated through an oxidant path between the connector and extending through the center tube; and a support ring surrounding the distal end of the outer casing, the support ring operable to provide a seal between an inner wall of the well liner and the outer casing when the coolant is pressurized within the coolant flow path.

2. The nozzle in claim 1, wherein the center tube and the outer casing are further connected and fixed at the connector by a non-welded connector which can be selected from the group consisting of an external grapple connector, a bayonet/positioning bolt, or a flange bolt.

3. The nozzle in claim 1, wherein for the non-sealed spiral flow pathway connecting the center tube and the outer casing have a depth and a width of a thread spacing, each independently 2-10 mm.

4. The nozzle in claim 1, wherein the nozzle is provided with 4-12 pairs of coolant inlets and coolant outlets corresponding to each other, communicating and matching with a plurality of spiral flow pathways on the end faces of the connection end and the injection nozzle end face, the pairs of coolant inlets and coolant outlets are evenly distributed about circumference.

5. The nozzle in claim 1, further comprising:

a support check valve provided inside each of the one or more oxidant injection holes, and when a plurality of oxidant injection holes are provided, these holes may be distributed along a nozzle centerline and a periphery, and one or more outer holes oriented from parallel to a center hole to outward divergence at an angle of 5-35° to the center hole.

6. The nozzle in claim 1, further comprising:

a plurality of micro venturi drainage patterns defined on the injection nozzle end face extending from the coolant outlet to the one or more oxidant injection hole for guiding the coolant to reach the one or more oxidant injection holes for cooling protection.

7. The nozzle in claim 1, wherein the support ring surrounding the outer casing near the injection nozzle end face, and a seal ring contained in an inner cavity of the support ring, the inner cavity being in communication with the spiral flow pathway, the seal ring is ejected to sealingly engage an inner surface of the well liner when the coolant is injected into the inner cavity.

8. An injection system for an underground coal gasification process having an injection well liner as a conveying channel to an underground coal seam, the injection system comprising:

a coiled tubing, a mechanical shearing device, and a nozzle connected gas tight in series with each other, the coiled tubing is operable to move the injection device through the injection well liner to a pre-determined location in the underground coal seam for gasification, and, if necessary, retract all or part of the injection system to a surface;

the mechanical shearing device configured to separate the nozzle when necessary to retract the remainder of the injection system;

the nozzle configured to inject a coolant and an oxidant into the coal seam for gasification, the nozzle having an outer casing and a center tube coaxially aligned, an annular space defined between the outer casing and the center tube, a non-sealed spiral pathway defined within the annular space having a coolant inlet defined in an annular rim at a proximal end of the outer casing and an coolant outlet defined at an injection nozzle end face a distal end of the outer casing, the nozzle configured to communicate a coolant carried in a coolant pathway defined between the liner and the coiled tubing to the injection nozzle end face; and a support ring surrounding the distal end of the nozzle, the support ring selectively operable by the coolant to sealingly engage the outer casing with an inner surface of the well casing.

9. The injection system of claim 8, wherein a main check valve is provided between the coiled tubing and the mechanical shearing device to prevent a reverse gas flow into the coiled tubing, and the main check valve is further provided with a support component for positioning and retaining of the nozzle with an inner wall of the injection well liner.

10. The injection system in claim 9, further comprising:

a support component of the main check valve, the support component having a plurality of sets of circumferentially evenly distributed U-shaped support legs, a spring and a roller carried in the cavity of the U-shaped support legs, with the roller in direct contact with the inner wall of the injection well liner.

11. The injection system in claim 9, wherein the mechanical shearing device comprises:

a main body of the mechanical shearing device, an outer casing of the mechanical shearing device and a sheath pin, wherein the sheath pin is configured to separate the main body and outer casing of the mechanical shearing device to disconnect the nozzle from the coiled tubing.

12. The injection system in claim 8, wherein the nozzle is coupled to the coiled tubing via a gas-tight seal by a non-welded connection selected from the group consisting of an external grapple connector, a quick connector, a bayonet/positioning bolt, and a flange bolt.

13. The injection system in claim 8, further comprising:

a pneumatic protection plug provided at the injection nozzle end face for protecting the injection nozzle end face when the injection device transits the the well casing, the pneumatic protection plug operable to be ejected by a high pressure reagent flow after the start of a reagent injection.

14. An operating method of a well completion system for an underground coal gasification process in an underground coal seam, comprising:

inserting a well casing from a ground surface to the underground coal seam;

inserting a coiled tubing through the well casing by a wellhead control device, the coiled tubing having a nozzle releasably coupled to a distal end and a proximal end configured to be coupled to an oxidant source;

positioning the nozzle proximal to the underground coal seam with the wellhead control device;

applying a pressurized source of a coolant to a coolant pathway defined between an inner surface of the well casing and the coiled tubing to extend a seal of a ring support surrounding a distal end of the nozzle for engagement of the seal with the inner surface of the well casing;

circulating the coolant through a non-sealed spiral pathway disposed between an outer casing of the nozzle and a coaxial center tube of the nozzle, the non-sealed spiral pathway having an inlet defined through an annular protrusion at a proximal end of the outer casing and an outlet distal to the ring support to project the coolant from an injection end face at the distal end of the nozzle;

applying a pressurized source of an oxidant to the coiled tubing to inject the oxidant into the underground coal seam via one or more oxidant injection holes in the injection end face of the nozzle, the coiled tubing and the center tube, and oxidant injection holes defining an oxidant pathway; and igniting the oxidant to provide a high temperature combustion zone and a gasification zone in the coal seam.

15. The operation method in claim 14, further comprising:

continuously injecting a high concentration oxidant into the underground coal seam through the oxidant pathway during a gasification stage, wherein the high concentration oxidant is oxygen-enriched air with at least 80 vol % oxygen or pure oxygen; and injecting the coolant as a gasification agent for the coal gasification process, wherein the coolant is selected from the group consisting of water, steam or carbon dioxide.

16. The operation method in claim 15, further comprising:

monitoring each of a distributed temperature, a pressure sensor, and an acoustic wave sensor coupled to the nozzle at the wellhead control device, reflecting a plurality of process parameters; and controlling the plurality of process parameters of the underground coal gasification process by the wellhead control device.

17. The operation method in claim 16, further comprising:

distributing wherein the distributed temperature, pressure and acoustic wave sensor are distributed via an optical fiber operated on an Optical Time-Domain Reflectometry, wherein the optical fiber extends from near the wellhead control device to a target measuring point at the oxidant injection hole, and controlling the flow rate of coolant injection based on the measured temperature at the oxidant injection hole.

18. The operation method of claim 14, further comprising:

igniting the underground coal seam in a delayed manner by one of;

injecting the oxidant flow through the oxidant pathway; or applying a pressure to activate and subsequently disconnect the underground ignition device, wherein a low flow rate of air is used as an ignition oxidant and injected into the underground coal seam through the coolant pathway.

19. The operation method of claim 14, further comprising:

adjusting an injection pressure and/or a flow rate of the coolant to selectively release the seal from the inner surface of the injection well liner;

retracting the nozzle a predetermined distance according to a specified time interval;

adjusting the injection pressure and/or the flow to extend the seal in engagement with the injection well liner; and continue the gasification process until all the coal in the direction of the injection well liner is consumed.

20. The operation method of claim 19, further comprising:

controlling a burn rate of the injection well liner in front of the injection end face by reducing the flow rate of the coolant injection after retracting so that fresh coal seam can be exposed to the high temperature combustion zone and the gasification zone.

* * * * *